United States Patent [19]

Youngborg

[11] Patent Number: 4,650,633

[45] Date of Patent: Mar. 17, 1987

[54] METHOD AND APPARATUS FOR PROTECTION OF PUMP SYSTEMS

[75] Inventor: Lamont H. Youngborg, San Jose, Calif.

[73] Assignee: General Electric Company, San Jose, Calif.

[21] Appl. No.: 627,109

[22] Filed: Jul. 2, 1984

[51] Int. Cl.[4] ..... G21C 7/00; F04B 49/00

[52] U.S. Cl. ..... 376/210; 376/216; 376/247; 376/241; 417/26; 417/27; 417/282; 417/292

[58] Field of Search ..... 417/26, 27, 44, 45, 417/279, 280, 282, 292, 300; 376/210, 211, 216, 217, 241, 245, 247, 281, 297

[56] References Cited

U.S. PATENT DOCUMENTS

| | | | |
|---|---|---|---|
| 3,180,266 | 4/1965 | Smith | 417/282 |
| 3,931,503 | 1/1976 | Berbile et al. | 376/210 |
| 4,108,720 | 8/1978 | Sato et al. | 376/210 |
| 4,204,808 | 4/1980 | Reese et al. | 417/45 |
| 4,322,267 | 3/1982 | Kinoshita et al. | 376/210 |
| 4,440,715 | 4/1984 | Sato et al. | 376/210 |
| 4,472,345 | 9/1984 | Tanji et al. | 376/241 |
| 4,560,323 | 12/1985 | Orchard | 417/27 |

FOREIGN PATENT DOCUMENTS

| | | | |
|---|---|---|---|
| 59-137898 | 8/1984 | Japan | 376/210 |
| 59-218998 | 12/1984 | Japan | 376/210 |

OTHER PUBLICATIONS

Sulzer-Forschungshift 1971, S. 25-34.

Siemens-Zeitschrift, 9/65, Heft 9, S. 1039-1045 Jung et al.

*Primary Examiner*—Salvatore Cangialosi

*Attorney, Agent, or Firm*—Ivor J. James, Jr.; Raymond G. Simkins

[57] ABSTRACT

A control apparatus and method for restricting liquid flow in a liquid moving pump, usually of the centrifugal type, to prevent pump cavitation and pump prime mover overloading. The control apparatus includes sensors to detect liquid temperature and pressure at the inlet of the pump. It may further include a device such as a current transformer to develop a signal indicative of power consumed by the prime mover of the pump where the prime mover is an electrical motor. The liquid pressure and temperature indications are used to generate a specific indication of the subcooling of the liquid. The temperature indication is used to derive an indication of the instantaneous required subcooling of the pump. The subcooling indication and the required subcooling indication are introduced to a comparator. Should the subcooling of the liquid fail to exceed the required subcooling, a first control signal is generated. Simultaneously, a signal indicating power consumption may be fed to a second comparator along with a power limit signal. Should power consumption exceed the power consumption limit, a second control signal is generated. As long as either control signal is generated, progressive restriction of liquid flow through the pump is effected.

15 Claims, 5 Drawing Figures

METHOD AND APPARATUS FOR PROTECTION OF PUMP SYSTEMS

The invention relates to a method and apparatus for protecting pumps and pump prime movers. Among numerous applications of the invention is the protection of such pump systems where used in returning condensate to a steam generator, such as that of a nuclear reactor.

BACKGROUND OF THE INVENTION

In well known, commercial, boiling water nuclear power reactors, a pressure vessel contains a core of fuel material submerged in a liquid such as light water, which serves both as a working fluid and a neutron moderator.

The water is circulated through the core, whereby a portion thereof is converted to steam. The steam is taken from the pressure vessel and applied to a prime mover, such as a turbine, for driving an electric generator. The turbine exhaust steam is condensed and, along with any necessary makeup water, is returned to the pressure vessel by a condensate delivery system.

Typically, nuclear reactors are provided with water level control systems which monitor water level within the vessel, steam outflow from the vessel, and feedwater inflow into the vessel. Water level control systems manipulate the operation of the condensate delivery system to control water level in the reactor vessel. Should steam outflow exceed feedwater inflow, the water level control system will tend to direct an increase in feedwater flow into the vessel. Similarly, for an excess of feedwater flow over steam flow, the fluid level control system will tend to direct a decrease in feedwater flow into the vessel. An indication of water level imbalance in the vessel will, however, dominate a signal generated by a steam and feedwater flow imbalance. A high water level indication will result in a demand for a reduction in feedwater flow. A low water level indication will result in a demand for an increase in feedwater flow. U.S. Pat. No. 4,302,288 discloses exemplary reactor water level control systems and is expressly incorporated herein by reference.

Feedwater pumps in condensate delivery systems are typically driven by one of two means. Where feedwater pumps are driven by electric motors, feedwater flow can be controlled by directing the feedwater through a flow control valve and positioning the valve, according to the demands of the water level control system, to reduce or increase resistance to flow. In some nuclear plants, feedwater pumps are driven by turbines which utilize steam from the reactor vessel. In such cases, feedwater flow can be controlled by varying the amount of steam delivered to these turbines. A flow control valve is included in the steam delivery pipes to permit such control.

Adjustments affecting feedwater flow through the feedwater pump also affect water pressure at both the pump outlet and inlet. By way of example, opening a valve used for flow control in the feedwater line will result in an increase in flow with a commensurate increase in the load on the motor driving the pump. Pressure at the pump inlet will fall. As another example, an increasing quantity of steam delivered to a turbine driving a pump will cause the pump to accelerate with an attendant decrease in inlet pressure. Feedwater flow will increase.

The typical condensate delivery system comprises a plurality of centrifugal pumps. The feedwater pumps are those pumps which raise feedwater water pressure to the level of pressure inside the reactor vessel. The feedwater is typically at an elevated temperature. Water pressure is subject to variation at various internal points of a centrifugal pump during pump operation. Although average water pressure increases as the water penetrates the pump, local pressure within the pump may, through turbulence and other factors, drop considerably below pump inlet pressure. Should local pressure fall enough, flash boiling of the water with consequent pump cavitation can result. This adversely effects pump efficiency and can result in damage to the pump.

Boiling occurs at saturation of the water at local pressure. That is to say, water is saturated when further additions of heat, or a decrease in local pressure, causes some of the water to change to a vapor. If a sufficient difference between the enthalpy of the water in the pump inlet and the enthalpy at saturation of the water at local pressure within the pump is maintained, boiling is prevented. This difference in enthalpy from inlet to pump interior is termed subcooling and is expressed in units of enthalpy, e.g. BTU/LBM. The subcooling required by any given pump varies with water temperature. Such characteristics of centrifugal pumps have long been known and data thereon is generally available from the pump manufacturer. Heretofore, protective measures to prevent pump cavitation have typically employed a pressure trigger to shut down the pump prime mover whenever pump inlet pressure has fallen below a predetermined value. Such pressure triggers operate at the chosen predetermined value for all water temperatures. Pressure trigger protective measures have been utilized in nuclear power plants.

While the required subcooling for a given pump may increase or decrease for various combinations of temperature and pressure, adequate subcooling for a given pump can be obtained at lower pump inlet pressures as water temperature falls. Consequently, unnecessary triggering of protective steps can occur where a simple pressure trigger is used. In a nuclear power plant, a pressure-triggered feedwater pump shutdown resulting in a partial cut-off of water flow to the reactor could undesirably necessitate a scram of the reactor. Such pump system shutdowns are more likely to occur when maintaining maximum feedwater flow to the vessel is especially important to avoid a reactor scram. An example of such a case would be when reactor water level is low, and the feedwater level control system is attempting to increase feedwater flow.

Another concern with existing systems is that increased flow demand results not only in reduced pressure, but in increased load on the pump motor, where motors are used. As the motor slows with increased load from its normal operating speed, it consumes more power and draws more current. For especially high load demands, the excessive current drawn can trigger a relay which shuts off the motor, again potentially resulting in a reactor scram.

The operating history of nuclear reactors shows that cavitation and pump motor overloading in pump systems occurs far more frequently in feedwater pump systems than in condensate pump systems. Thus various embodiments of the invention are depicted as employed with feedwater pumps.

Accordingly, it is an object of the present invention to provide a system for controlling the feedwater flow rate, which overrides demands for feedwater flow that are not sustainable by the condensate delivery system.

It is another object of the present invention to monitor the subcooling of a liquid before introduction of the liquid into a motive pump and to compare the subcooling to the subcooling required in the liquid to prevent cavitation in the pump.

It is a still further object of the present invention to monitor a parameter indicative of power consumed by a pump prime mover and to effect changes in pump load to reduce power consumption by the prime mover when power consumption is excessive.

It is an object of the present invention to allow the condensate delivery system to achieve maximum feedwater flow under adverse system operating conditions.

It is an additional object of the present invention to monitor system parameters most directly indicative of conditions within a liquid flow line and actuate protective apparatus on the basis thereof.

It is a yet further object of the present invention to prevent cascading shutdowns of equipment resulting in unnecessary scrams of a nuclear reactor.

SUMMARY OF THE INVENTION

The present invention achieves these and other objects, according to one aspect of the invention, by providing, in a feedwater flowline including at least one feedwater pump, means in the flow line downstream from the pump for controlling flow through the line, a prime mover for the feedwater pump, sensors in the inlet of the pump for generating signals indicative of feedwater pressure and temperature, means for calculating the subcooling of the liquid in the pump inlet and generating a signal proportional thereto, means for providing a signal proportional to the predetermined required subcooling for the pump at the measured temperature of the liquid, a first comparator circuit for generating a first control signal should the subcooling be less than the required subcooling, means for monitoring a parameter related to power consumption by the pump prime mover and generating a signal proportional thereto, means generating a signal indicative of maximum permissible power consumption, a second comparator circuit for generating a second control signal should power consumption exceed a predetermined limit, a logical OR circuit for transmitting a positioning signal in response to either comparator generating a control signal, integrator means for boosting the positioning signal in response to the signal duration, and means to transmit the positioning signal to valve positioning means to position the valve so as to progressively reduce flow through the flow line.

The aforesaid system provides an improvement over existing nuclear reactor water level control systems and pump system protection apparatus. By providing valve positioning signals to the feedwater flow control valve indicative of excessive power use and/or conditions conducive for pump cavitation, flow is progressively reduced and flowline system resistance to flow is progressively increased for as long as out of bounds conditions persist. Two significant parameters are controlled. Pressure through the pump system immediately upstream of the valve increases. Such a pressure increase improves water subcooling for any given temperature. Secondly, flow is reduced, and thus the load on the pump prime mover is reduced.

A second preferred embodiment is disclosed below which sets forth application of the invention to turbine driven feedwater pumps. The second embodiment teaches generation of a pressure difference signal correlated with required subcooling. Either of the disclosed embodiments may be adapted for use with feedwater pumps driven by electric motors or with steam driven turbines.

Each disclosed embodiment is shown incorporating an optional delay line which is used to trigger prime mover shutdowns should excessive power usage or reduced subcooling levels persist beyond certain time limits.

Thus, it can readily be seen that the invention aids in maintaining pump efficiency and can, in combination with a water level control apparatus, maintain maximum sustainable flow through the flow line while avoiding pump damage or an unnecessary reactor scram.

DETAILED DESCRIPTION

Figure 1:
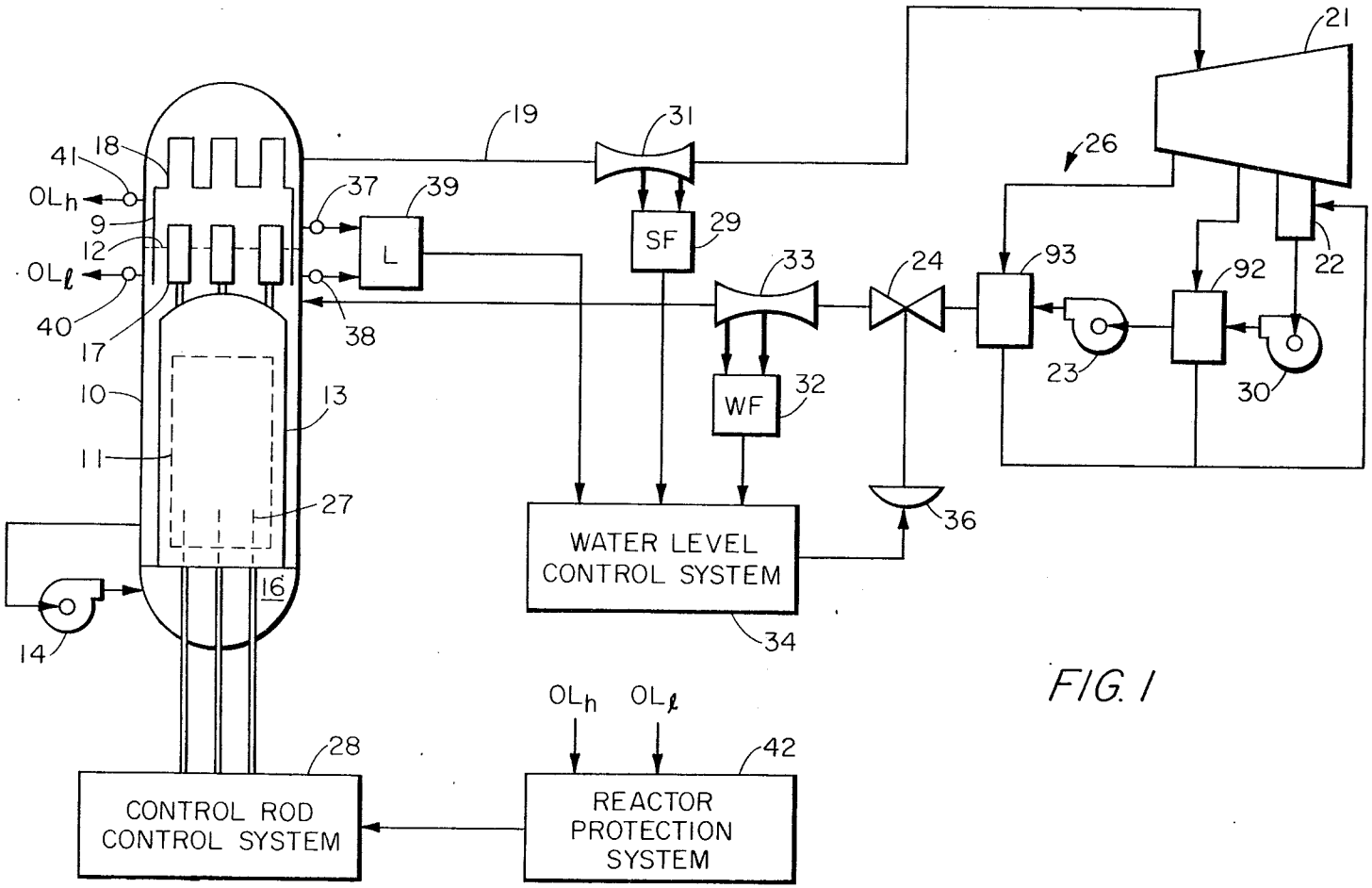
FIG. 1 is a schematic illustration of a nuclear reactor and an associated water level control system.

The invention as described herein, is employed with a water cooled and moderated nuclear reactor of the boiling water type, an example of which is illustrated in simplified schematic form in FIG. 1. Such a reactor system includes a pressure vessel 10 containing a nuclear fuel core 11 submerged in a coolant-moderator such as lightwater, the normal water level being indicated at 12.

A shroud 13 surrounds the core 11, and a coolant circulation pump 14 pressurizes a lower chamber 16 from which coolant is forced upward through the core 11. A part of the water coolant is converted to steam which passes through seperators 17 which are inside a dryer seal skirt 9, dryers 18, and thence through a steam line 19 to a utilization device such as a turbine 21. A portion of the steam is diverted from turbine 21 through preheaters 92 and 93 in a feedwater flowline 26. Condensate formed in a condenser 22, along with any necessary make-up water, is returned as feedwater to the vessel 10 by a condensate pump 30, a subsequent feedwater pump 23 and through a control valve 24 in the feedwater line 26.

A plurality of control rods 27, containing neutron absorber material, are provided to control the level of power generation and to shutdown the reactor when necessary. Such control rods 27 are selectively insertable among the fuel assemblies of the core under control of a control rod control system 28.

For proper reactor operation, it is necessary to maintain the water level in vessel 10 within predetermined upper and lower limits. A general approach to such water level control will now be discussed. A first aspect of such control is a comparison between the steam outflow from the vessel with the feedwater in-flow.

A signal proportional to the steam flow rate is provided by a steam flow sensor 29, which may be a differential pressure transmitter that senses the differential pressure from a pair of spaced pressure taps in a flow measuring device 31 placed in the steam line 19.

Similarly, a signal proportional to the feedwater flow rate is provided by a sensor 32 which may be in the form of a differential pressure transmitter connected to a flow measuring device 33 in the feedwater line 26.

The signals from flow sensors 29 and 32 are transmitted to a feedwater control system 34 wherein one is subtracted from the other. A difference of zero indicates that outflow and inflow are the same and the water level will remain constant. If the difference is other than zero, a signal corresponding in sign and proportional in amplitude to the difference is applied to valve controller 36, which adjusts the valve 24 in a manner to bring steam outflow and feedwater inflow toward balance. This arrangement provides rapid correction and normally maintains vessel water level within the bounds of a relatively narrow deadband. However, it does not sense or control the position of the water level in the vessel.

Thus, a second aspect of water level control is the provision of an upper water level pressure tap 37 and a lower water level pressure tap 38 which provide signals from which the position of the water level can be determined. The pressure taps 37 and 38 communicate with the interior of the vessel 10 and are connected to a differential pressure transmitter 39 which converts the difference in pressure at taps 37 and 38 to an output signal indicative of the position of the water level 12. This signal is applied to the feedwater control system 34 and is employed therein to modify the control signal to valve controller 36 whereby the valve 24 is controlled to adjust the feedwater flow rate and thereby maintain the position of the water level 12 within the prescribed upper and lower normal operating limits. (Although not shown here for clarity of drawing, it is noted that the usual system employs two or more sets of pumps 23 and 30, valves 24, and controllers 36 connected in parallel. See FIG. 2.)

If for some reason, such as component failure, the water level control system 34 fails to maintain the water level within normal limits, the water level may become excessively low or high. A level detector 40 is provided to detect an excessively low, out-of-limits water level, and to produce a signal $OL_1$. Similarly, a level detector 41 is provided to detect an excessively high water level and to produce a signal $OL_h$. These signals are received by a Reactor Protection System 42, which responds to an out-of-limits condition by signaling the control rod control system 28 to insert the control rods and scram the reactor.

These and other water level control systems, to which the present invention can advantageously be applied, are set forth in detail in U.S. Pat. No. 4,302,288, incorporated above.

Figure 2:
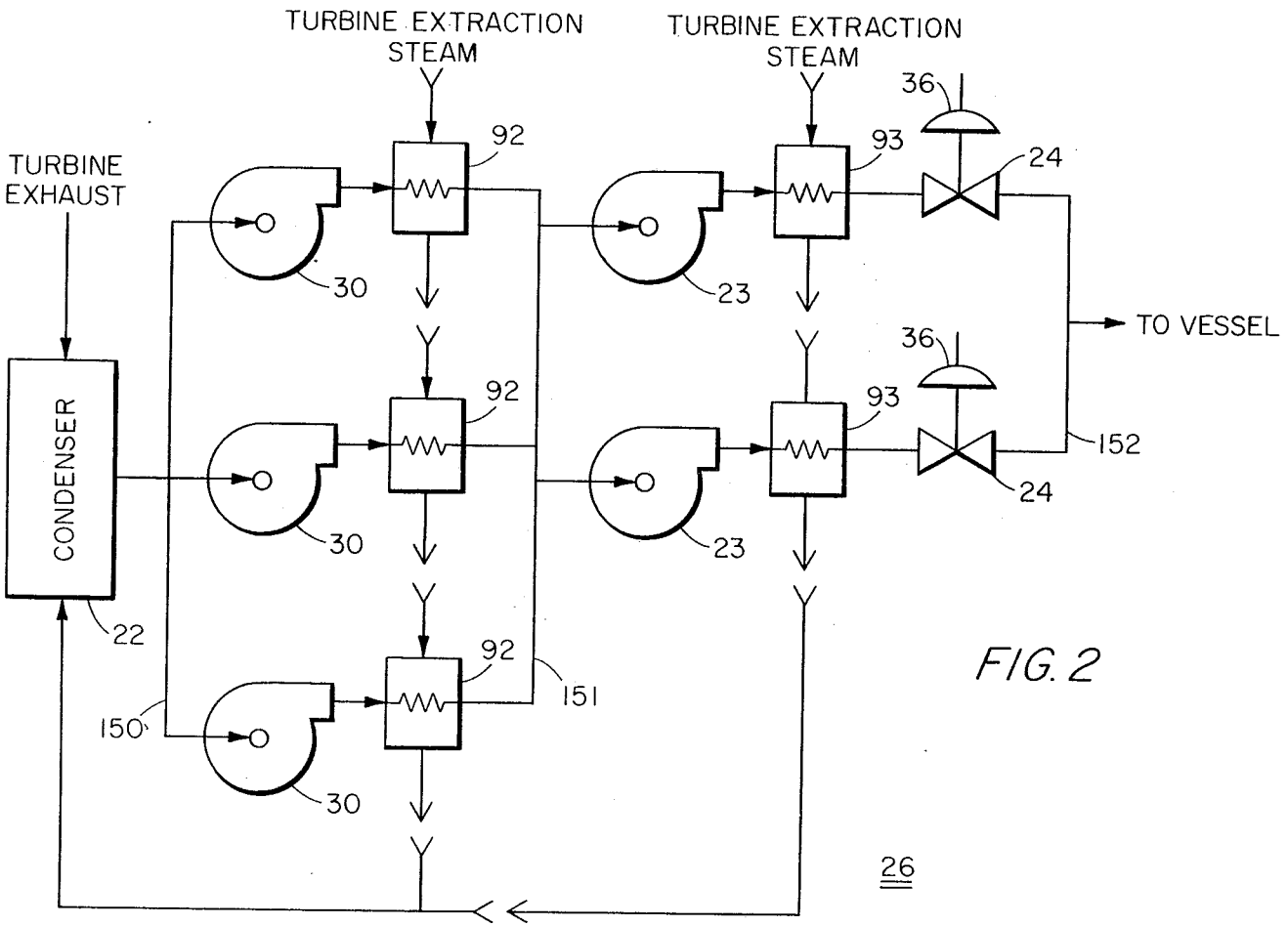
FIG. 2 is a schematic illustration of a pump arrangement for a typical condensate delivery system.

Referring to FIG. 2, an overview of a typical condensate delivery system is shown. Elements used for active control of feedwater temperature or pressure are schematically depicted.

Condenser 22 collects condensate from a power turbine and from preheaters 92 and 93. Condensate is delivered to three condensate pumps 30 through a one into three manifold 150. The condensate is delivered as feedwater through the condensate pumps, and its temperature is raised by passing it through preheaters 92. The preheaters utilize steam extracted from the power turbine. The feedwater is then brought into a 3 into 2 manifold 151 for delivery to two feedwater pumps 23. Preheaters 93 are provided after the outputs of the feedwater pumps. If the condensate delivery system incorporates motor driven feedwater pumps, flow control valves 24 are incorporated in each flow line immediately after the last preheat stage. A two into one manifold 152 then delivers the feedwater to the reactor vessel.

As noted above, a typical condensate delivery system comprises a plurality of centrifugal pumps. The use of groups of pumps connected in parallel provides benefits of redundancy in case one pump fails. Polyphase electrical motors and/or steam driven turbines are utilized to provide motive force to the various pumps. Where turbines are used, flow control means for steam delivered to those turbines can be substituted for flow control means 24 in the feedwater flow lines.

Condensate is typically at a temperature of 10°–20° F. above ambient temperature and at a pressure of 20–25 inches of mercury. The condensate pumps boost the pressure of the feedwater to approximately 700 psig. Preheaters 92 raise the water temperature to about 375° F. The feedwater pumps then boost the water pressure to about 1075 psig. All of the above figures are for normal operation and under certain circumstances can be expected to vary.

Figure 3:
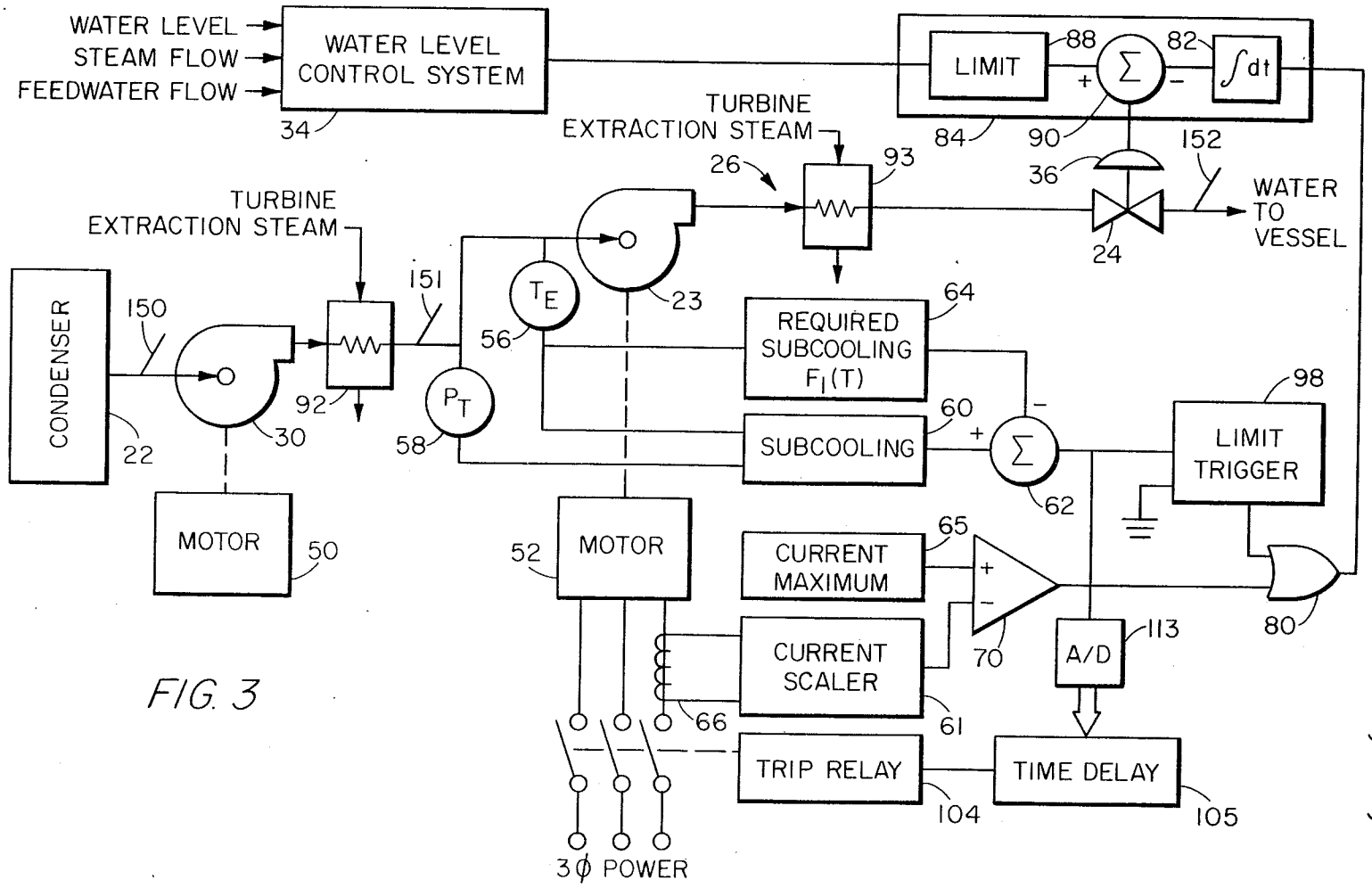
FIG. 3 is a schematic illustration of a feedwater pump system protection system as applied to a condensate delivery system using motor driven feedwater pumps.

In FIG. 3, a preferred embodiment of the present invention is set forth. The condensate delivery system is depicted as having only two inline pumps for the sake of clarity. The positions of manifolds 150, 151 and 152 are shown. Each feedwater pump in a condensate delivery system will have a pump system protection system. Accordingly, each flow control valve 24 is independently controlled. Feedwater flowline 26 comprises the various pumps, pipes and valves used to connect condenser 22 to the reactor vessel 10. Condenser 22 is directly connected to the condensate pump 30. The condensate pump leads into the feedwater pump 23. The feedwater pump 23 communicates with the pressure vessel 10 through the flow control valve 24. The pumps 23 and 30 typically are centrifugal pumps.

Drive motors 50 and 52 drive the condensate and feedwater pumps respectively. Generally, a three phase, non-synchronous induction type motor is used.

The flow control valve 24 is adapted to be selectively positioned by valve controller 36.

Preheaters 92 and 93 use steam diverted from the turbine 21 to raise the temperature of the feedwater being introduced to the reactor vessel. Preheater 92 heats water flowing in the feedwater line 26 between the condensate pump 30 and the feedwater pump 23. Preheater 93 heats water received from the feedwater pump.

A temperature sensor 56 and a pressure sensor 58 are provided in the intake 54 of the feedwater pump 23. Each sensor develops an electrical signal proportional to the value of the physical condition measured. The temperature signal is thus proportional to the temperature of the feedwater in the pump intake. The pressure signal is proportional to the water pressure in the pump intake. The water temperature during normal operation is typically 375° F., although it will be lower when the reactor system is not operating at full power. Normal water pressure in the intake is about 700 psig.

The temperature signal and the pressure signal are processed by appropriate circuitry in a subcooling processor 60. The subcooling processor may include a microprocessor adapted to perform a table lookup operation. The temperature signal and the pressure signal are processed by individual analog to digital converters. Subcooling values for the matrix of discrete pressures and temperatures are provided in memory. The microprocessor determines the appropriate address in memory from the temperature and pressure indications and thus generates a subcooling level indication. A digital to analog converter processes the subcooling indication from the accessed memory register. A signal value, correlated with the subcooling of the water in the pump intake, is thus provided. The correlated signal is transmitted to the non-inverting terminal of a summer 62. The subcooling function is non-analytic and is depicted graphically in FIG. 5.

The limit signal generator 64 receives the temperature signal from the feedwater pump intake. The limit signal generator is a function generator which matches the measured temperature to a required predetermined value of subcooling needed to prevent cavitation in the feedwater pump at that temperature. Such subcooling values are provided from test data supplied by the manufacturer. A representative set of values is depicted graphically in FIG. 5. The circuit can be realized with a calibrated constant current source and a summing node. A particular quantity of subcooling required at a given temperature implies a certain minimum pressure for that temperature. A signal proportional to the subcooling required is transmitted to the inverting input terminal of the summer 62. Summer 62 develops a signal proportional to the subcooling margin of feedwater entering the feedwater pump 23. A negative signal indicates a negative margin and the consequent possibility of cavitation. This signal is transmitted to a subcooling limit trigger 98.

Subcooling limit trigger 98 generates a constant valued, positive "on" signal should the subcooling determined by subcooling processor 60 be less than the minimum required; that is should the signal from summer 62 be negative with respect to ground reference. This occurs when the subcooling processor 60 generates a signal smaller than the required subcooling signal from subcooling generator 64. The limit trigger can be realized using a Schmitt trigger with following inverter. Any signal generated by limit trigger 98 is transmitted to a first input terminal of an OR GATE 80. The output signal from OR GATE 80 is applied to a valve position control signal generator 84 for control of flow control valve 24, as described hereinafter.

As mentioned above, three phase induction motors may be used provide motive force to the pumps in the feedwater flow line. Such motors draw electrical current at a constant voltage and frequency and convert it to mechanical power and torque in response to the load imposed on the motor. Such motors are adapted to draw increasing current to produce increasing mechanical power and torque throughout their useful operating range. Such motors also include power limit switches, which disconnect the motor from its supply lines should electrical power consumption rise above a predetermined limit. The electrical power consumption of the motor is given by the relation:

$$P=(3)^{\frac{1}{2}} \cos \phi V_{11} I_b$$

where $\cos \phi$ is the inphase component of the current drawn (power factor)

$V_{11}$ is line to line voltage $I_b$ is branch current

The power factor, $\cos \phi$, in the operational area of the motor can be treated as a constant for operating values of interest here. Also, the line to line voltage is assumed to be constant. Thus, $I_b$ varies almost directly with power consumed and this is correlated with the load driven by the motor. Current drawn is monitored as an indication of power consumed. Other conditions could be monitored as such an indication, e.g., motor rotational velocity, or power could be calculated by monitoring the above values and using the above relationship. However, a current monitor provides a reliable, easily resolvable, and relatively inexpensive indicator. Accordingly, a current transformer 66 is applied to one of the three power input lines 68 of a drive motor 52. This is proportional to the total power as the time average current drawn in any one of the three lines of a symetrical motor is equal to that drawn on any one other line. A signal proportional to that of current drawn is induced in the current transformer and transmitted to a current scaler 61, which reduces that signal to a signal appropriately scaled to the subsequent limit trigger 70. The scaled current is introduced to the inverting terminal of trigger 70. A second signal, a steady current limit signal from a calibrated current source, is provided to the non-inverting terminal of limit trigger 70 from current limit generator 65. Should the indicative signal from the current scaler 61 exceed the current limit signal, the limit trigger 70 will produce a fixed, positive valued output signal. This signal is transmitted to a second input terminal of OR GATE 80.

OR GATE 80 operates conventionally and transmits a signal to an integrator 82 in the valve position control signal generator 84 in response to either indication signal. The valve position control signal generator 84 receives and sums input signals from both an existing water level control system 34, such as described hereinbefore, and the pump system protection system. The signal from the water level control system 34 is introduced to the valve position control signal generator 84 through a signal limiter 88 which limits a positive indication (i.e., an indication to begin opening the flow control valve) to a predetermined maximum value. Such a limiter can be built using an operational amplifier with a resistive negative feedback loop. The integrator 82 produces an output signal which increases with time for as long as an output signal is received from OR GATE 80. Integrator 82 can be realized using an operational amplifier with capacitive feedback.

The output signals from signal limiter 88 and integrator 82 are introduced, respectively, to the positive and negative terminals of a summing amplifier 90. Summer 90 generates the actual valve position control signal which is applied to valve controller 36. Integrator 82 and limiter 88 are provided so that when conflicting demands are made by the respective systems, i.e. the pump system protection system and the water level control system, the pump system protection system eventually prevails. This arrangement maintains pump operation in case of a heavy demand for feedwater flow.

A time delay shutdown trigger may be incorporated, as a backup shutdown device, into the aforedescribed pump system protection system. The subcooling margin signal generated by summer 62 is transmitted to an analog to digital converter 113. A/D 113 provides the data input to time delay calculator 105 which is adapted to transmit a trip signal to relay 104 which, in turn, can cut off power to drive motor 52 under circumstances to be described below. Calculator 105 incorporates a microprocessor programmed to trigger a timing mechanism should the subcooling margin become negative and fall below a first minimum value, for example −10 BTU/LBM. As subcooling initially falls through the first minimum, the timer begins a 30 second countdown, which, should it come to completion, will cause a trip signal to be transmitted to relay 104. A series of secondary minimums are provided in memory, which if passed result in set quantities of time being subtracted from the aforesaid timer. For example, if the subcooling margin falls below −20 BTU/LBM, 10 seconds are subtracted from the running timer. If the subcooling margin falls to −30 BTU/LBM, 15 additional seconds are subtracted from the timer. A sudden decline in subcooling from a safe positive level to −30 BTU/LBM allows the pump protection system a maximum of 5 seconds to restore satisfactory operating margins. The timer is stopped and reset should subcooling margin recover to a predetermined minimum, for example, −5 BTU/LBM.

Figure 4:
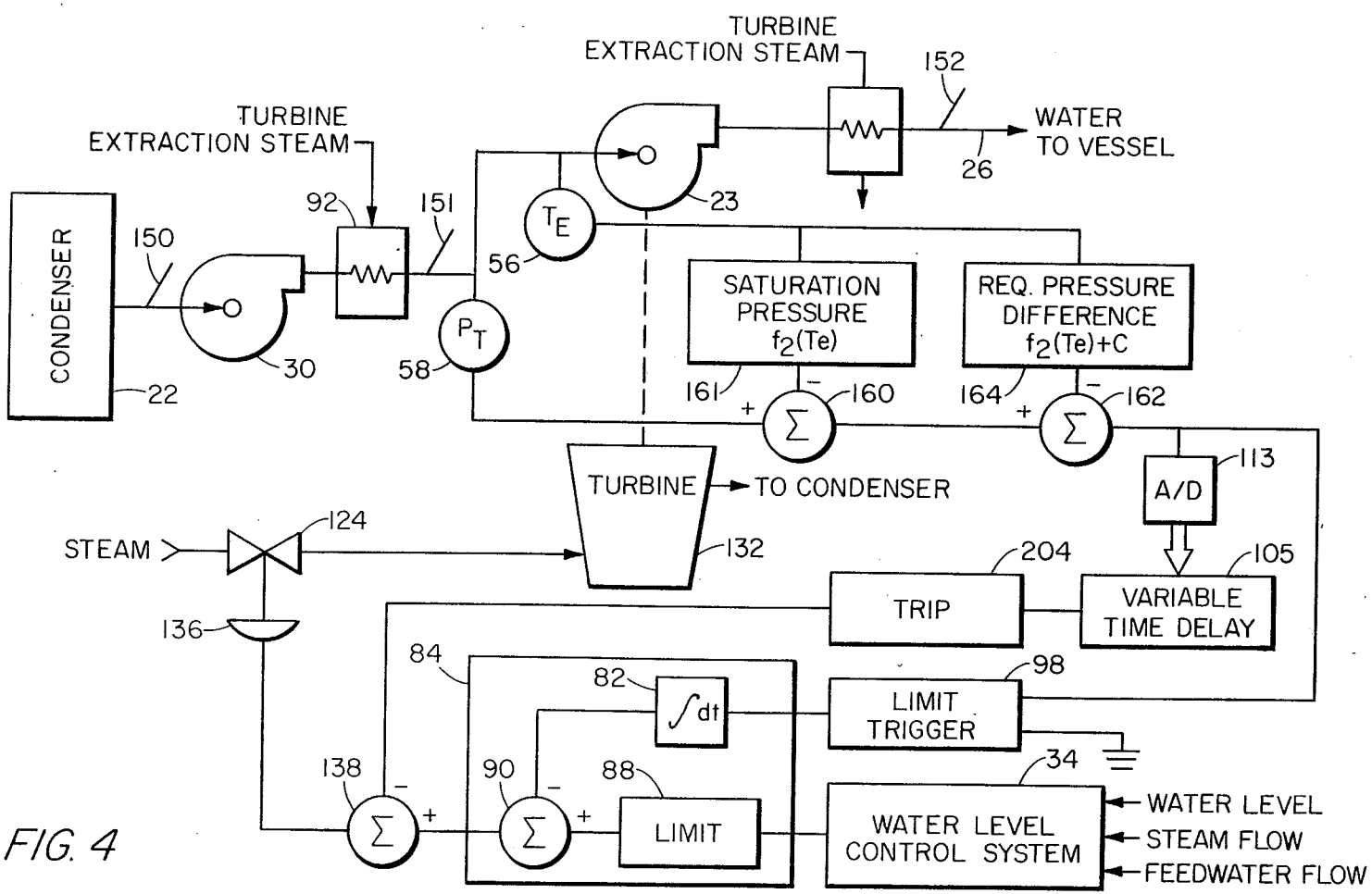
FIG. 4 is a schematic illustration of a second preferred embodiment of the invention as applied to a condensate delivery system with turbine driven feedwater pumps.

Referring now to FIG. 4, a second preferred embodiment of the invention will be discussed.

The specific embodiment of the invention depicted is a primarily analog realization of the invention. As before, a pressure sensor 58 and a temperature sensor 56 are introduced to the inlet of a feedwater pump 23. The signal generated by the temperature sensor is transmitted to a saturation pressure function generator 161. The saturation pressure function generator 161 is a one input function generator which generates a signal proportional to what the pressure sensor 58 would generate if the water were saturated at that temperature. Function generator 161 is realized with a calibrated current source and a summing node. Accordingly, the signal generated by function generator 161 is equal to or less than the signal produced by pressure sensor 58. The saturation pressure signal is subtracted from actual pressure at summer 160. The resulting pressure difference signal is the pressure margin which is correlated with pump inlet subcooling.

The pressure difference signal, from junction 160, is introduced to the positive terminal of a summer 162. Function generator 164 provides a temperature dependent, required pressure difference signal which correlates with adequate subcooling at each operating temperature. Function generator 164 is a one input generator and may be realized as a calibrated current source and summing node.

The signal generated by function generator 164 is transmitted to the negative terminal of summer 162.

Should the value of the difference signal fall below the signal from function generator 164, the signal from summer 162 will become negative.

Again a subcooling limit trigger 98 is provided to generate a fixed, positive valued control signal should summer 162 generate a negative valued signal, indicative of an inadequate pressure margin needed to assure an adequate subcooling margin.

The depicted condensate delivery system utilizes a steam driven turbine 132 to drive the feedwater pump 23. Control of flow through the flowline 26 is effected through control of the motive force driving turbine 132. Control is achieved by controlling the quantity of steam introduced to turbine 132. A flow control valve 124 is included in the steam to turbine delivery line for this purpose.

Valve controller 84 performs the same function in the embodiment in FIG. 4 as in the previously discussed embodiment of FIG. 3. The signal produced is applied through a summer 138 to a valve position controller 136, which controls steam flow to turbine 132 by positioning flow control valve 124 according to the demands of the water level control and pump protection systems. Accordingly, a demand for increased feedwater flow will result in opening of the steamflow control valve 124. An overriding signal that pump cavitation is threatened results in progressive repositioning of valve 124 to reduce steam flow. Such variation in steam flow controls turbine energization and thereby controls feedwater flow through pump 23. The reduced flow through the pump allows the condensate pumps to restore pressure to the pump inlet reducing the danger of pump cavitation.

As in the case of the embodiment of FIG. 3, a time delay shutdown trigger may be incorporated as a backup shutdown device in the embodiment of FIG. 4. An analog to ditigal converter converts the pressure margin signal from summer 162 into a digital input for time delay calculator 105, which is the same as calculator 105 described for FIG. 3. Note, however, that pressure margin levels are substituted for subcooling margins as minimum trigger levels for the timer. Trip generator 204 is connected to receive a trip signal from calculator 105. On receipt of a trip signal, trip generator 204 develops a valve position signal of sufficient magnitude to dominate all other inputs to summer 138. The resulting signal from 138 is transmitted to valve position 136 and closure of flow control valve 124 is effected.

A turbine cannot draw power in a manner analogous to an electrical motor. Accordingly, it is not necessary to monitor the power consumed by the turbine. The power monitoring aspect of the invention is not used in the second embodiment.

It will be understood that the analog based embodiment described immediately above may be substituted for the microprocessor based embodiment described in relation to the motor driven feedwater pump. Likewise, the microprocessor based embodiment can be applied to a turbine driven pump system.

The operation of the invention is hereinafter elaborated upon with reference to FIGS. 1, 2, 3, 4, and 5, as appropriate.

FIRST EXAMPLE

Consider the first preferred embodiment. Condensate is collected in condenser 22 at approximately atmospheric pressure. The condensate pump 30 boosts pressure to approximately 700 psig. The feedwater pump 23 further boosts this to approximately 1075 psig for reintroduction to the pressure vessel. Suppose water temperature at the feedwater pump inlet is 375° F. Flow is controlled through the aforementioned flow control valve 24. This is normal operation. Required subcooling is about 75 BTU/LBM.

Suppose that the water level control system detects a steam flow greatly in excess of feedwater flow. This condition may be a consequence, for example, of a leak in the feedwater line upstream from the feedwater flow measuring device 33. If not responded to, it portends a coming reduction in water level within the reactor vessel. Accordingly, the water level control system transmits a signal to the valve position control signal operator which generates a command to the valve position controller to begin opening the valve to increase feedwater flow. Increasing flow is associated with decreasing pressure at the inlet of the feedwater pump. System operating conditions will begin to move downward on the curve denoted "MARGIN" in FIG. 5. As flow increases, the load on the motor 52 driving the pump 23 increases. Consequently, current drawn by the drive motor 52 increases. As can be observed from FIG. 5, subcooling will decrease as pressure falls (water temperature remains constant). Should the point marked "minimum" be crossed, a signal will be provided by the feedwater pump system protection system through control signal generator 84 to valve controller 36 to move valve 24 toward its closed position maintaining the minimum subcooling necessary to prevent pump cavitation. Likewise, if current drawn by motor 52 becomes excessive, a signal will be generated to close the valve 24 to reduce flow and thereby reduce load. Integrator 82 assures that these signals dominate the signal from the water level control system.

EXAMPLE 2

Figure 5:
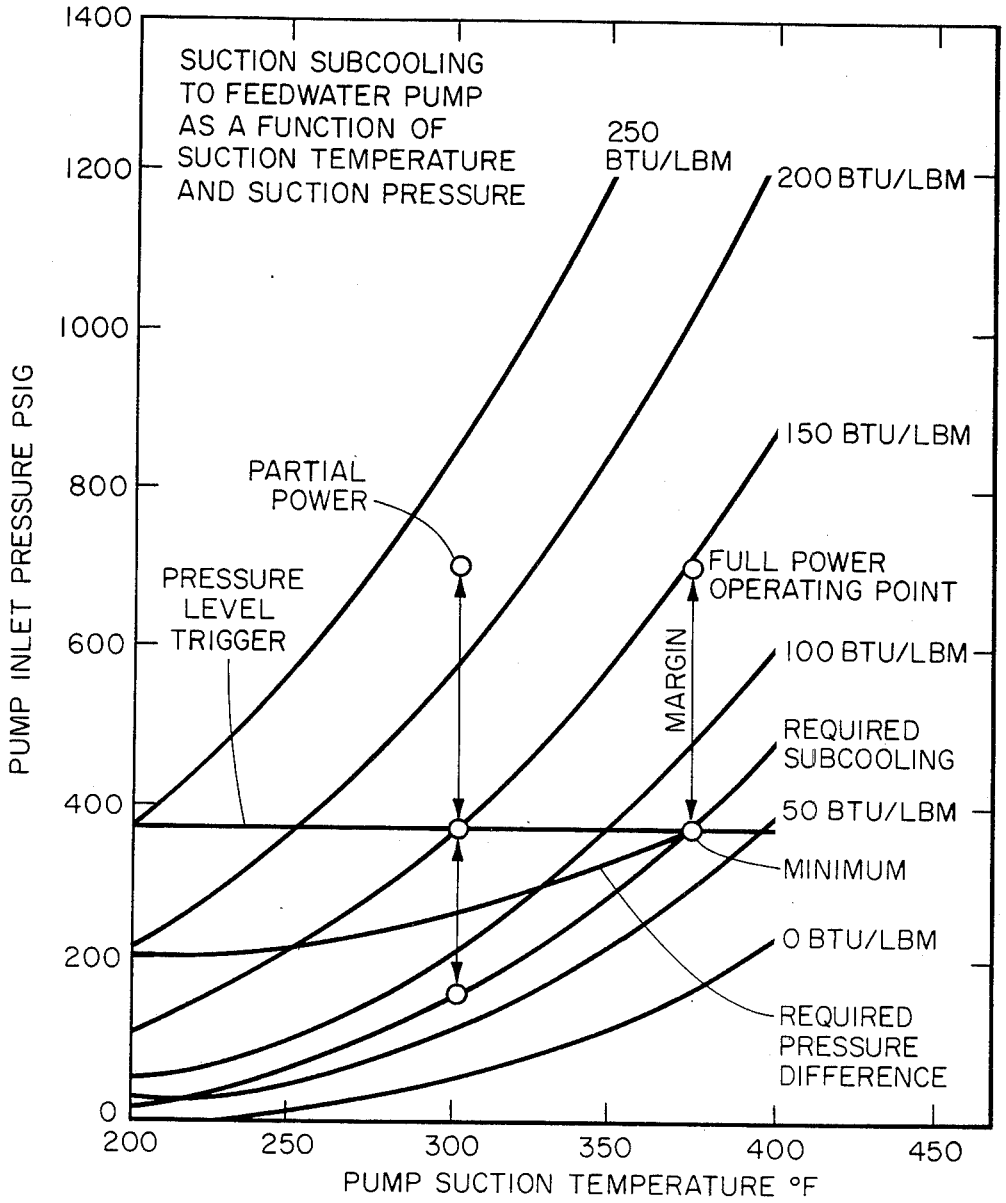
FIG. 5 is a graphical representation of feedwater subcooling as a function of inlet gauge pressure and temperature.

Suppose operation of the same plant as above, but under partial power. Referring to FIG. 5, an exemplary partial power operating point is so labeled. If the condensate delivery system is operating normally, feedwater pump inlet pressure will be uneffected from the full power operating point. However, pump inlet temperature will be substantially reduced.

The system would be operating with approximately 225 BTU/LBM subcooling. The required minimum subcooling would be about 70 BTU/LBM. A prior art pressure trigger would trigger a motor shutdown at a pressure, which would yield subcooling of about 155 BTU/LBM.

A variety of causes could result in a rapid reduction in feedwater pump inlet gauge pressure below the 375 psig level at which pressure triggers have been set to activate. A failure of a condensate pump could reduce pressure below the previously employed pressure trigger level but not put the pump into actual danger of cavitation. The condensate delivery system could tolerate one condensate pump failure and remain operational. An unnecessary reactor scram would be avoided.

In the exemplary embodiments of the invention described above and shown in FIGS. 4 and 5, the invention is shown as applied to a condensate delivery system in a nuclear power reactor. It will be readily apparent that the invention is not so limited and that it may be used as a reliable method and apparatus to protect pumps used in various settings, e.g. hydraulics. Various substitutions and modifications may also be made in the types of components used.

While certain embodiments of the present invention have been disclosed herein, it will be clear that numerous modifications, variations, substitutions, changes and full and partial equivalents will now occur to persons skilled in the art without departing from the spirit and scope of the invention herein. Accordingly, it is intended that the invention be limited only by the spirit and scope of the appended claims.

What is claimed is:

1. In a nuclear power plant having a fluid-filled reactor vessel with a vapor outflow line for removing vapor from said reactor vessel, liquid inflow means for injecting liquid to said reactor vessel, said inflow means including an inflow line, a centrifugal pump disposed along said inflow line having an inlet and an outlet, an induction motor to drive said pump, flow control means along said inflow line between said pump and said reactor vessel from said pump, and means for generating a first control signal in response to liquid level in said reactor vessel and net vapor outflow versus liquid inflow with respect to said reactor vessel, said first control signal generating means being effective to generate a first signal to open and a second signal to close said flow control means to maintain liquid level in said vessel within predetermined limits, a pump and pump motor protection apparatus comprising:

means for measuring the pressure of said liquid in the inlet of said pump;

means for measuring the temperature of said liquid in the inlet of said pump;

means for determining a required subcooling for said pump at the instantaneous temperature of said liquid in the inlet of said pump;

means for determining the enthalpy of said liquid in the inlet of said pump from the pressure and temperature of said liquid;

means for comparing the enthalpy of said liquid in said inlet against the required subcooling and for generating a first indicative signal when the enthalpy of said liquid fails to exceed the required subcooling, whereby said first indicative signal indicates potential cavitation in said pump;

means for developing a signal indicative of the instantaneous power consumed by said motor;

means for comparing the level of power consumption by said motor against a predetermined maximum power and generating a second indicative signal should said power limited be exceeded whereby said second indicative signal indicates potential pump motor overload;

an OR GATE for receiving said first and second indicative signals and generating a unipolarity second control signal in response to either said first or said second indicative signals; and control signal summing means for algebraically summing said second control signal with said first control signal to develop a valve position signal to close the positioning of said flow control means;

whereby said flow control means is moved toward its closed position in response to an indication of motor overload or potential cavitation in said pump.

2. In a system as set forth in claim 1, said first indicative signal generating means including limit trigger means effective to generate a fixed potential output signal for said first indicative signal.

3. In a system as set forth in claim 2, signal limiting means for limiting said first control signal to a maximum value when it is of said first polarity.

4. In a system as set forth in claim 3, signal integrating means disposed to increase said second control signal over time before introduction to said summing circuit to insure that said second control signal will dominate said first control signal.

5. In a system as set forth in claim 4, wherein said subcooling determination means includes digital electronics means including a memory, whereby said pressure and temperature indications may be processed to facilitate addressing an appropriate register in said memory to develop subcooling indication.

6. In a system having a flowline for transporting a liquid, a pump with an inlet and an outlet in said flowline, means to drive said pump, and flow control means adapted to control flow through said pump, a method for protecting said pump comprising the steps of:

(a) measuring the pressure of said liquid flowing into said pump and generating a pressure indication signal in response thereto;

(b) measuring the temperature of said liquid flowing into said pump and generating a temperature indication signal in response thereto;

(c) providing from said temperature a comparison signal related to the required subcooling for said pump;

(d) at least periodically developing an enthalpy indication signal correlated with the temperature and pressure indication signals;

(e) comparing said required subcooling signal with said enthalpy signal; and (f) actuating said flow control means to steadily reduce liquid flow through said flowline so long as said enthalpy signal fails to exceed required subcooling as determined in step (e).

7. In a method as set forth in claim 6, wherein said step of at least periodically determining said enthalpy indication is provided by;

(i) generating an indication signal of saturation pressure as a function of water temperature in said pump inlet, and (ii) subtracting said saturation pressure indication signal from said pressure signal.

8. In a method as set forth in claim 7, wherein said step of comprising is done by generating from said temperture indication a signal related to the required minimum pressure difference between actual pump inlet pressure and saturation pressure at current temperature.

9. In a method as set forth with claim 6, wherein said means for driving said pump comprises an induction electric motor, said method including the additional steps of:

(g) monitoring the rate of power consumption by said motor;

(h) continually comparing the rate of power consumption with a predetermined allowable maximum rate of power consumption; and (i) actuating said flow control means to steadily reduce liquid flow through said flowline so long as said power consumption exceeds said maximum allowable power consumption.

10. In a method as set forth in claim 7, wherein said step of at least periodically determining said enthalpy indication is provided by;

(i) providing a microprocessor with memory, said memory being adapted to provide subcooling indications for discrete combinations of water temperature and water pressure, (ii) introducing said temperature and pressure indications to said microprocessor whereby said microprocessor is enabled to periodically perform a table look-up operation for said discrete subcooling indication, and (iii) providing means to convert said subcooling indication to an analog indication of subcooling.

11. In a nuclear power plant system having a fluid-filled reactor vessel with a vapor outflow line for removing vapor from said reactor vessel, liquid inflow means for injecting liquid to said reactor vessel, said inflow means including an inflow line, a centrifugal pump disposed along said inflow line, a controllable prime mover for driving said pump, and means for generating a first control signal in response to a liquid level in said vessel and net vapor outflow versus liquid inflow with respect to said vessel, a pump system protection apparatus comprising:

means for measuring the pressure of said liquid in the inlet of said pump;

means for measuring the temperature of said liquid in the inlet of said pump;

means for indicating the required subcooling for said liquid entering said pump at the measured temperature of said liquid;

means for determining the enthalpy of said liquid in the inlet of said pump from the measured pressure and measured temperature of said liquid;

means for comparing the enthalpy of said liquid in said inlet against the required subcooling and for generating a second control signal when the enthalpy of said liquid fails to exceed said required subcooling; and control signal summing means for algebraically subtracting said second control signal from said first control signal to develop a prime mover control signal to control energization of said prime mover;

whereby said prime mover is energized at a level such that cavitation in said pump is prevented.

12. In a system as set forth in claim 11, said means for generating a second control signal comprising a trigger signal generator adapted to generate a constant valued output signal for said second control signal.

13. In a system as set forth in claim 12, signal limiting means for limiting said first control signal to a maximum value when it indicates a demand for increased energization of said prime mover.

14. In a system as set forth in claim 13, signal integrating means disposed to increase said second control signal over time, before application to said summing circuit, to insure that said second control signal will dominate said first control signal should both be present.

15. In a system as set forth in claim 1, wherein said working medium is water.

* * * * *